US007191765B2

(12) United States Patent
Santero

(10) Patent No.: US 7,191,765 B2
(45) Date of Patent: Mar. 20, 2007

(54) DEVICE FOR CONTROL OF ELECTRO-ACTUATORS WITH DETECTION OF THE INSTANT OF END OF ACTUATION, AND METHOD FOR DETECTION OF THE INSTANT OF END OF ACTUATION OF AN ELECTRO-ACTUATOR

(75) Inventor: Paolo Santero, Orbassano (IT)

(73) Assignee: C.R.F. Societa Consortile per Anzioni (IT)

( * ) Notice: Subject to any disclaimer, the term of this patent is extended or adjusted under 35 U.S.C. 154(b) by 58 days.

(21) Appl. No.: 10/993,373

(22) Filed: Nov. 19, 2004

(65) Prior Publication Data

US 2005/0180085 A1 Aug. 18, 2005

(30) Foreign Application Priority Data

Nov. 20, 2003 (IT) ..... TO2003A0921

(51) Int. Cl.
*F02M 51/00* (2006.01)
*H01H 9/00* (2006.01)

(52) U.S. Cl. ..... 123/490; 361/154

(58) Field of Classification Search ..... 123/490; 73/119 A; 361/152–154, 16 O
See application file for complete search history.

(56) References Cited

U.S. PATENT DOCUMENTS 3,732,492 A * 5/1973 Geul ..... 73/119 A
4,553,207 A * 11/1985 Veneziano ..... 73/119 A
4,687,994 A * 8/1987 Fulkerson et al. ..... 73/119 A
4,856,482 A * 8/1989 Linder et al. ..... 123/506
5,053,911 A * 10/1991 Kopec et al. ..... 123/490
5,182,517 A * 1/1993 Thelen et al. ..... 361/152
5,245,501 A * 9/1993 Locher et al. ..... 361/154
5,433,109 A * 7/1995 Mayer-Dick et al. ..... 73/119 A
5,650,909 A 7/1997 Remele et al. ..... 361/154
5,668,476 A * 9/1997 Archer ..... 361/154
5,738,071 A * 4/1998 Smith et al. ..... 123/357
5,747,684 A * 5/1998 Pace et al. ..... 73/119 A
5,825,216 A * 10/1998 Archer et al. ..... 123/490
5,995,356 A * 11/1999 Glavmo et al. ..... 361/154
2005/0066940 A1 * 3/2005 Sheikh et al. ..... 73/119 A

FOREIGN PATENT DOCUMENTS

DE 3730523 3/1989
EP 0 924 589 A1 6/1999
GB 2 262 809 A 6/1993

* cited by examiner

*Primary Examiner*—T. M. Argenbright
(74) *Attorney, Agent, or Firm*—Ostrolenk, Faber, Gerb & Soffen, LLP

(57) ABSTRACT

A description is provided of a device (2) for control of an electro-actuator (3), comprising a first and a second input terminal (4,5) which are connected to an electrical energy source (6); and a first and a second output terminal (10,11) which are connected to the electro-actuator (3). The control device (2) additionally comprises a threshold comparator (30) which can compare the voltage ($V_{HS}$,$V_{LS}$) present at the first or second output terminal (10,11) of the control device (2) with a threshold voltage ($V_{TH_EOI}$) and can generate a signal ($V_{EOI}$) which is indicative of the instant of end of actuation of the electro-actuator, when this voltage ($V_{HS}$, $V_{LS}$) passes through the threshold voltage ($V_{TH_EOI}$).

12 Claims, 1 Drawing Sheet

Figure 1:
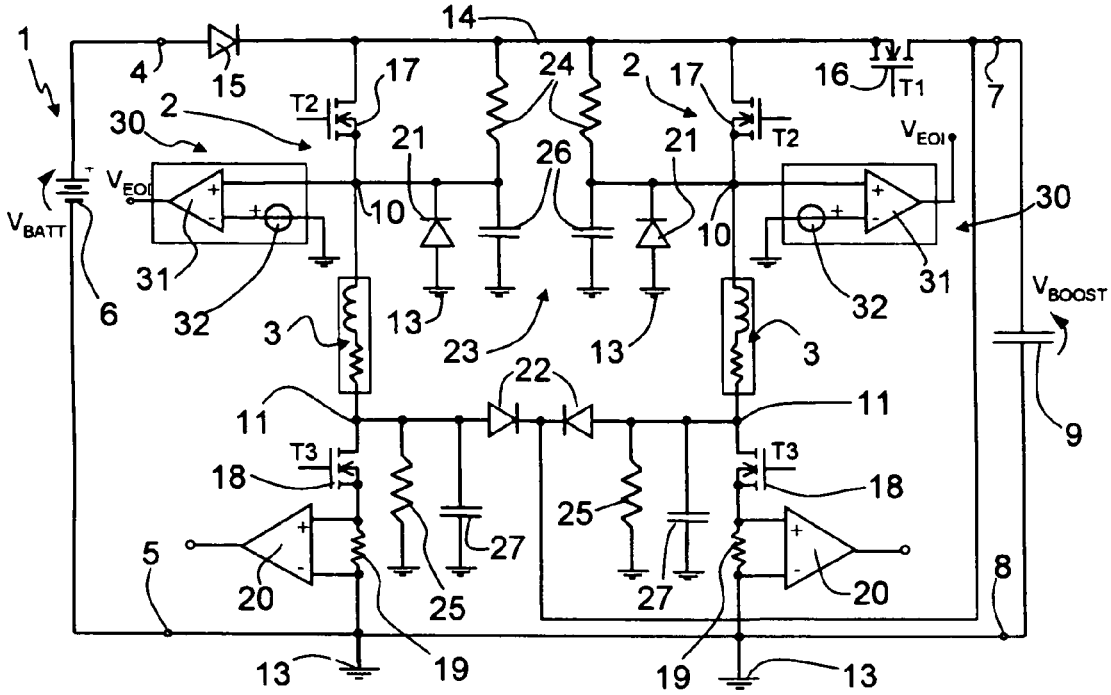

DEVICE FOR CONTROL OF ELECTRO-ACTUATORS WITH DETECTION OF THE INSTANT OF END OF ACTUATION, AND METHOD FOR DETECTION OF THE INSTANT OF END OF ACTUATION OF AN ELECTRO-ACTUATOR

The present invention relates to a device for control of electro-actuators with detection of the instant of end of actuation and to a method for detection of the instant of end of actuation of an electro-actuator.

In particular, the present invention can be applied advantageously, but not exclusively in the control of electro-injectors of a fuel injection system of an internal combustion engine of a motor vehicle, and in particular a common rail injection system of a diesel engine, to which the description will refer explicitly, without however detracting from generality.

The control device according to the invention can however be applied to other types of engines, such as petrol, methane or LPG engines, or to any other type of electro-actuators such as, for example, solenoid valves of ABS devices and the like, solenoid valves of variable timing systems, etc.

As is known, for control of the electro-injectors of a common rail injection system, each electro-injector is habitually supplied with a current, the development of which over a period of time generally comprises three distinct and repeated stages, i.e. a first stage of rapid increase in order to give rise to opening of the electro-injector, a second stage of amplitude which oscillates around a certain maintenance value in order to control the opening of the electro-injector, and a third stage of rapid decrease to a value of approximately zero, in order to give rise to closure of the electro-injector.

In fact, as is known, an electro-injector comprises an outer body defining a cavity which communicates with the exterior via an injection nozzle, and in which there is accommodated a pin which is mobile axially in order to open and close the nozzle, under the opposite axial thrusts of the pressure of the fuel injected on the one hand, and of a spring and a rod on the other hand, which rod is disposed along the axis of the pin, on the side opposite the nozzle, and is activated by an electro-magnetically controlled metering valve.

In the initial stage of opening of the electro-injector, it is necessary not only to apply considerable force against the action of the spring, but also the rod must be moved from the position of rest to the position of activation in the shortest possible time. For this reason, the excitation current for the electromagnet in the first stage is somewhat high and increases rapidly in order to guarantee sufficient temporal precision at the moment of initiation of the activation. However, once the rod has reached the final position, the electro-injector remains open even with currents which are less high, such as the sections of decrease and maintenance around a certain maintenance value in the development of the excitation current of the electro-magnet.

European patent EP 0 924 589 in the name of the applicant describes a control device for electro-injectors which supplies a current with the above-described temporal development, to each electro-injector.

In particular, the device described in the aforementioned European patent makes it possible to carry out multiple injections at short intervals on each cylinder, wherein multiple injections means the possibility of carrying out two or more injections in each cylinder per engine cycle, and the term injections at short intervals defines each consecutive pair of injections carried out in the same cylinder and in the same engine cycle, for which the temporal interval between the end of the first and the start of the second injection is small or tends towards zero.

The temporal interval between two injections at short intervals is usually defined as the dwell time. In particular, reference is made to the hydraulic dwell time if account is taken of the distance between two curves of capacity (or flow) of the fuel injected by the electro-injectors in the two consecutive injections, or to the electrical dwell time if account is taken of the interval between the electrical commands imparted to the electro-injector (in particular the piloting current) in the two consecutive injections.

Hereinafter, reference will be made exclusively to the electrical dwell time, since this is controlled directly by the device for control of the electro-injectors. The hydraulic dwell time, which is important in order to determine the dynamics of the combustion inside the cylinder, can easily be determined once the electrical dwell time is known, provided that the physical parameters of the system are known, and in particular the pressure of the fuel.

It is known that accurate control of the dwell time is of fundamental importance in order to implement specific engine control strategies, in particular for reduction of the exhaust emissions, consumption and combustion noise. In this respect, it is sufficient to take into consideration that, during injections at short intervals, small variations of the dwell time can give rise to strong fluctuations in the quantity of fuel injected in the second injection, because of the pressure oscillations which occur in the manifold and in the injection pipes further to the first injection.

Although it is thus necessary to control the dwell time accurately, the known control circuits, such as that which is described in the aforementioned European patent, are not sufficiently accurate in providing this control.

In fact, whereas the control logic of the control device of the electro-injectors provides extremely accurately the instant of starting of a fuel injection, corresponding to the instant at which the injection current starts to increase, beginning from zero, the same logic cannot determine accurately the instant of end of injection, i.e. the instant at which the injection current stops, which is usually known as "End Of Injection" (EOI). For this reason, the control logic cannot determine the instant to begin calculating the start of the dwell time between one fuel injection and the next.

In fact, although it is known that the development of the injection current during the rapid discharge stage which leads to stoppage of the injection current corresponds substantially to an exponential discharge governed by the equivalent inductance of the electro-injector and by the equivalent series resistance of the grid through which the current passes, various factors exist which in fact make it impossible to determine mathematically the duration of rapid discharge itself, and thus the instant of end of injection.

Amongst these factors, the main ones which make it impossible to determine the instant of the end of injection mathematically are the following:

- the equivalent series resistance of the grid through which the current passes in the rapid discharge stage is derived from the equivalent resistance of the electro-injector and the resistance of the connection cables, both of which are associated with the temperature, which is not known. In addition, various parasitic parameters exist, such as the resistance of the tracks of the printed circuit on which the control device for the electro-injectors is provided, the ESR (Equivalent Series Resistance) of the capacitors present in the circuit, and the contact resistors, which are also dependent on the temperature and ageing of the device, and cannot be determined accurately;

the value of the equivalent inductance of the electro-injector is not constant and can also differ greatly from the nominal value, for example because of the movement of the rod of the electro-injector itself, which determines the variation of the air gap in the magnetic circuit of the electro-injector, with consequent variation of the flow of the magnetic field and of the induced counter-electromotive force, or also because of the inevitable parasitic currents which are present in the magnetic material;

the supply voltage which supplies the control device for the electro-injectors is not constant, but varies in a voltage range of 1÷2 V; and the current level starting from which the rapid discharge stage starts is known with a certain tolerance, owing to the fact that the injection current is maintained by the control circuit in a range of values in which it oscillates (typically ±1 A).

The object of the present invention is thus to provide a device for control of electro-actuators, which is free from the above-described disadvantages, and which in particular makes it possible to determine simply and economically, but at the same time accurately, the instant of end of injection, in order to make it possible to control the dwell time accurately.

According to the present invention, a device for control of an electro-actuator is provided, and a method is also provided for detection of the instant of end of actuation of an electro-actuator.

Figure 2:
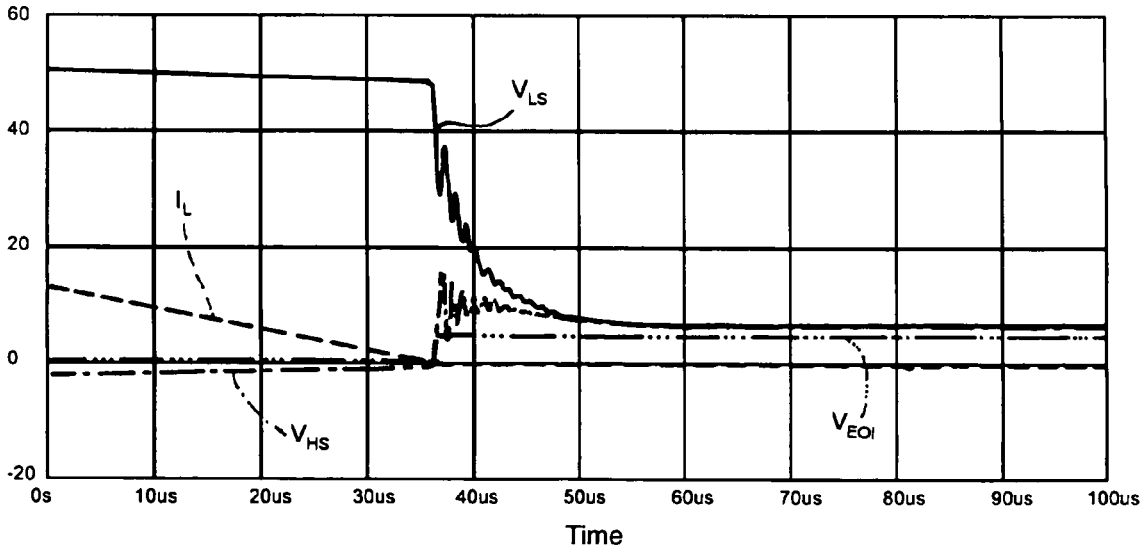

In order to assist understanding of the present invention, a preferred embodiment is now described, purely by way of non-limiting example, and with reference to the attached figures, in which:

FIG. 1 shows a circuit diagram of a device for control of electro-injectors according to a preferred embodiment of the present invention; and FIG. 2 shows the circuit developments of some electrical parameters of the circuit in FIG. 1.

As shown in FIG. 1, the control device, which is indicated as 1 as a whole, comprises a plurality of control circuits 2, one for each electro-injector 3. For the sake of simplicity of illustration, FIG. 1 shows only two control circuits 2 relating to two electro-injectors 3, which belong to a single engine bearing (not shown), each of which is represented in FIG. 1 with its corresponding equivalent circuit formed by a resistor $R_{INJ}$ and an inductor $L_{INJ}$ connected in series.

Each control circuit 2 comprises a first and a second input terminal 4, 5, which are connected respectively to the positive pole and to the negative pole of the battery 6 of the motor vehicle, which provides a voltage $V_{BATT}$, the nominal value of which is typically equivalent to 13.5 V; a third and a fourth input terminal 7, 8, which are connected to a booster circuit 9 which is common to all the control circuits 2, and supplies a boosted voltage $V_{BOOST}$ which is greater than the battery voltage $V_{BATT}$, for example 50V; and a first and a second output terminal 10, 11, between which a corresponding electro-injector 3 is connected. In its simplest embodiment, the booster circuit is formed by a single capacitor 9, known as the "boost" capacitor.

The terminal of each electro-injector 3 connected to the first output terminal 10 of the corresponding control circuit 2, is typically known as the "highside" (HS) or hot-side terminal, whereas the terminal of each electro-injector 3 connected to the second output terminal 11 of the corresponding control circuit 2 is typically known as the "lowside" (LS) or cold-side terminal.

Each control circuit 2 additionally comprises a ground line 13 which is connected to the second input terminal 5 and to the fourth input terminal 8, and a supply line 14 which is connected on the one hand to the first input terminal 4 via a first diode 15, the anode of which is connected to the first input terminal 4 and the cathode of which is connected to the supply line 14, and is connected on the other hand to the third input terminal 7 via a first transistor 16 of the MOSFET type, the gate terminal of which receives a first control signal T1, the drain terminal of which is connected to the third input terminal 7, and the source terminal of which is connected to the supply line 14.

Each control circuit 2 additionally comprises a second transistor 17 of the MOSFET type, with a gate terminal which receives a second control signal T2, a drain terminal which is connected to the supply line 14, and a source terminal which is connected to the first output terminal 10; and a third transistor 18 of the MOSFET type with a gate terminal which receives a third control signal T3, a drain terminal which is connected to the second output terminal 11, and a source terminal which is connected to the ground line 13 via a sense stage, formed by a sense resistor 19, to the ends of which there is connected an operational amplifier 20 which generates as output a voltage which is proportional to the current which flows in the sense resistor 19 itself.

The transistors 17 and 18 are defined respectively as the "highside" and "lowside" transistors since they are connected respectively to the highside and lowside terminals of the corresponding electro-injectors 3.

Each control circuit 2 additionally comprises a second diode 21, known as the "free-wheeling" diode, the anode of which is connected to the ground line 13 and the cathode of which is connected to the first output terminal 10; and a third diode 22, known as the "boost" diode, the anode of which is connected to the second output terminal 11 and the cathode of which is connected to the third input terminal 7.

Each control circuit 2 additionally comprises a polarisation circuit 23 for the corresponding electro-injector 3. In particular, each polarisation circuit 23 comprise a first, pull-up resistor 24 which is connected between the first output terminal 10 and the supply line 14, and a second, pull-down resistor 25, which is connected between the second output terminal 11 and the ground line 13. The pull-up 24 and pull-down 25 resistors have the same value, for example equivalent to 5 kΩ, and ensure that in static conditions, i.e. when no injection is being carried out on the electro-injector, the voltage at the highside and lowside terminals of the electro-injectors 3 is set to a value which is equivalent to approximately ½ $V_{BATT}$. In fact, in static conditions, the inductor acts in the first approximation like a short-circuit between the highside and lowside terminals, and the two pull-up 24 and pull-down 25 resistors form a voltage divider between the supply line 14 and the ground line 13.

At the output terminals 10 and 11 of each control circuit 2, there are also connected two radio-frequency capacitors $C_{HS}$ 26 and $C_{LS}$ 27, which have a value of 1 nF for example, and connect the highside and lowside terminals respectively of the electro-injectors 3 in static conditions at the isopotential ground line 13, to the radio-frequency ground of the control device 1.

Finally, each control circuit 2 comprises a device for determination of the instant of end of injection, the purpose of which is to indicate to the engine control system the instant at which the injection of fuel into the corresponding electro-injector 3 ends.

In particular, the device for determination of the instant of end of injection is substantially formed by a threshold comparator 30, which has a first and a second input connected respectively to the first output terminal 10 and to the ground line 13, and an output which supplies a logic signal $V_{EOI}$. As shown in the figure, the threshold comparator 30 can advantageously be produced by means of an operational amplifier 31 and a threshold voltage generator 32. In particular, the operational amplifier 31 has a non-inverting terminal which is connected to the first output terminal 10, an inverting terminal which is connected to the ground line 13 via the corresponding threshold voltage generator 32, and an output which supplies the logic signal $V_{EOI}$. The threshold voltage generator 32 supplies a threshold voltage $V_{TH_EOI}$ and has a positive terminal connected to the inverting terminal of the operational amplifier 31 and a negative terminal connected to the ground line 13.

The general functioning of each control circuit 2 can be subdivided into three distinct main stages, characterised by a different development of the current circulating in the electro-injector 3, i.e. a first stage, known as the rapid-loading or boost stage, in which the current increases rapidly to a maintenance value, such as to open the electro-injector 3; a second stage, known as the maintenance stage, in which the current oscillates with a saw-tooth development around the value obtained in the preceding stage; and a third stage, known as the rapid-discharge stage, in which the current decreases rapidly from the value assumed in the preceding stage, to a final value, which can also be zero.

In particular, in the rapid-loading stage, the transistors 16, 17 and 18 are closed, and thus the boosted voltage $V_{BOOST}$ is applied to the ends of the electro-injector 3. By this means, the current flows in the grid comprising the capacitor 9, the transistor 16, the transistor 17, the electro-injector 3, the transistor 18 and the sense resistor 19, increasing over a period of time in a manner which is substantially linear with a gradient equivalent to $V_{BOOST}/L$ (where L represents the equivalent series inductance of the electro-injector 3). Since $V_{BOOST}$ is much greater than $V_{BATT}$, the increase in the current is much faster than that which can be obtained with $V_{BATT}$.

In the maintenance stage, the transistor 18 is closed, the transistor 16 is open and the transistor 17 is closed and opened repeatedly, and thus at the ends of the electro-injector 3 there is alternate application of the battery voltage $V_{BATT}$ (when the transistor 17 is closed) and a zero voltage (when the transistor 17 is open). In the first case (transistor 17 closed), the current flows in the grid comprising the battery 6, the diode 15, the transistor 17, the electro-injector 3, the transistor 18, and the sense resistor 19, and increases exponentially over a period of time, whereas in the second case (transistor 17 open), the current flows in the grid comprising the electro-injector 3, the transistor 18, the sense resistor 19 and the free-wheeling diode 21, and decreases exponentially over a period of time.

Finally, in the rapid discharge stage, the transistors 16, 17 and 18 are open, and thus, for as long as current passes through the electro-injector 3, the boosted voltage—$V_{BOOST}$ is applied to the terminals of the electro-injector 3 itself. By this means, the current flows in the grid comprising the capacitor 9, the boost diode 22, the electro-injector 3 and the free-wheeling diode 21, decreasing over a period of time in a substantially linear manner with a gradient equivalent to—$V_{BOOST}/L$. Since $V_{BOOST}$ is much greater than $V_{BATT}$, the decrease in the current is much faster than that which can be obtained with $V_{BATT}$. In this stage, the electrical energy which is stored in the electro-injector 3 (equivalent to $E=\frac{1}{2}\cdot L\cdot I^2$) is transferred to the capacitor 9, such as to permit recovery of part of the energy supplied by the control circuit 2 during the rapid-loading stage, thus increasing the efficiency of the system.

In the rapid-loading and maintenance stages, the opening and closing of the transistors 16, 17 and 18 is controlled by the engine control system on the basis of the logic signal supplied by the operational amplifier 20 which is connected to the ends of the sense resistor 19 and is indicative of the value of the current flowing in the electro-injector 3, whereas the duration of the rapid discharge stage is determined by calculation.

By means of the appropriate combination and repetition of some or all of the three above-described stages, each control circuit 2 can generate current profiles of the developed "peak and hold" type, with various types and degrees of complexity, thus making it possible to implement various strategies of injection of fuel, each comprising multiple injections at short intervals.

On the other hand, the functioning of the device for determination of the instant of end of injection is based substantially on the experimental finding that, when the current circulating in the electro-injector 3 stops, at the highside terminal of the electro-injector 3 itself there is generation of a voltage step, detection of which can thus provide precise indication of the instant of end of injection.

In fact, throughout the duration of the rapid-discharge stage, i.e. for as long as a non-zero current is circulating in the grid comprising the capacitor 9, the boost diode 22, the electro-injector 3 and the free-wheeling diode 21, the value of the voltage which is present at the highside and lowside terminals of the electro-injector 3 is fixed. In particular, the voltage of the highside terminal is at a voltage close to—1V, equivalent to the voltage drop at the free-wheeling diode 21, whereas the voltage of the lowside terminal is at a voltage close to 50V (the voltage $V_{BOOST}$, to which there is added the voltage drop at the boost diode 22). In addition, during the rapid-discharge stage, the radiofrequency capacitors $C_{HS}$ 26 and $C_{LS}$ 27 are loaded at the voltages which are present at the respective highside and lowside terminals; in particular, the capacitor $C_{HS}$ 26 is loaded at the voltage—1V, whereas the capacitor $C_{LS}$ 27 is loaded at the voltage 50V.

As soon as the current circulating in the electro-injector 3 stops, current no longer circulates in the free-wheeling 21 and boost 22 diodes, and the circuit comprising the electro-injector 3 is reduced to the grid formed by the capacitor $C_{HS}$ 26, the pull-up resistor 24, the electro-injector 3 itself, the capacitor $C_{LS}$ 27 and the pull-down resistor 25.

This circuit is a circuit of the RLC type with initial conditions which are determined by the voltages on the radiofrequency capacitors (reached during the rapid-discharge stage) and by the zero current on the electro-injector.

In the transitory response of the RLC circuit it is possible to determine two distinct dynamics which are partially superimposed.

The first dynamic is associated with the capacities of the radiofrequency capacitors $C_{HS}$ 26 and $C_{LS}$ 27 and with the equivalent inductance $L_{INJ}$ of the electro-injector 3. In particular, the two capacitors for the charge-sharing phenomenon tend firstly to go to the same voltage value, equivalent to approximately ½ $V_{BOOST}$, and subsequently, the presence of the inductance $L_{INJ}$ triggers oscillation which is damped by the presence of the equivalent resistor $R_{INJ}$ of the electro-injector 3 and has a frequency expressed by the formula:

$$f = \frac{1}{2 \cdot \pi \cdot \sqrt{L_{INJ} \cdot (C_{HS} // C_{LS})}} = \frac{1}{2 \cdot \pi \cdot \sqrt{2 \cdot L_{INJ} \cdot C_{HS}}}$$

and is typically equivalent to 550 kHz with the values of the components used.

When this oscillation has ended, the two radiofrequency capacitors $C_{HS}$ 26 and $C_{LS}$ 27 go to the same voltage once more.

On the other hand, the second dynamic is derived substantially from the pull-up resistor 24, the pull-down resistor 25 and the radiofrequency capacitors $C_{HS}$ 26 and $C_{LS}$ 27.

If the effect of the inductance $L_{INJ}$ of the electro-injector 3 is not taken into consideration, there is in fact simple exponential discharge starting from the initial voltage value equivalent to approximately ½ $V_{BOOST}$, up to the final operating value equivalent to approximately ½ $V_{BATT}$, imposed by the voltage divider consisting of the pull-up 24 and pull-down 25 resistors. The time constant which governs this exponential discharge is provided by the formula:

$$T=(R_{HS}//R_{LS})\cdot(C_{HS}//C_{LS})=R_{HS}\cdot C_{HS}$$

and has a typical value of approximately 5 μs.

The development arising from the transitory response of the circuit is thus an exponential with a negative exponent, decreasing from a voltage equivalent to ½ $V_{BOOST}$, to a voltage equivalent to ½ $V_{BATT}$, and on which there is superimposed an oscillation with frequency of approximately 550 KHz. In reality, this oscillation is damped by the losses caused by the parasitic currents present in the magnetic core of the electro-injector 3.

FIG. 2 shows the transitory development of the voltages, indicated respectively by $V_{HS}$ and $V_{LS}$, of the highside and lowside terminals of the electro-injector 3, when there is stoppage of the current, indicated by $I_L$, circulating in the electro-injector itself, which development is obtained by means of simulation, taking into account the losses in the magnetic material.

It can be noted that the voltage $V_{HS}$ at the highside terminal of the electro-injector 3 increases suddenly when the current $I_L$ in the electro-injector stops; in particular the voltage $V_{HS}$ of approximately −1 V goes to an operating value equivalent to approximately 7 V (½ $V_{BATT}$).

The rising front on the highside terminal can easily be determined by the device for determination of the instant of end of injection.

In particular, by setting a threshold voltage $V_{TH_EOI}$ of the threshold voltage generator 32 which is equivalent for example to 2V, as soon as the voltage $V_{HS}$ at the highside terminal of the electro-injector 3 exceeds this value, the threshold comparator 30 trips, thus making the logic signal $V_{EOI}$ switch.

In order to determine exactly the duration of the rapid-discharge stage itself, and thus the instant of end of injection EOI, it is therefore sufficient, for example by means of a simple counter, for the engine control system to measure the time which elapses between the start of the rapid-discharge stage and the rising front of the logic signal $V_{EOI}$ supplied by the threshold comparator 30. From that instant it is then possible to initiate counting of the dwell time required, such as to implement the corresponding engine control strategies.

Examination of the characteristics of the control device according to the present invention makes apparent the advantages which can be obtained by means of the device.

In particular, it is apparent that the device makes it possible to determine with precision the instant of end of injection EOI, and consequently to apply accurately a predetermined dwell time between two consecutive injections.

In addition, the engine control system need not be modified, thus minimizing the necessary modifications to be made to the existing circuitry.

Finally, it is apparent that modifications and variations can be made to the control device described and illustrated here, without departing from the protective scope of the present invention, as defined in the attached claims.

For example, the instant of end of injection could be determined by using the voltage step which is generated at the lowside terminal of an electro-injector, obviously with setting of an appropriate threshold voltage.

The invention claimed is:

1. A device for controlling an electro-actuator, comprising:

a first and a second input terminal operable to be connected in use to an electrical energy source; and a first and a second output terminal operable to be connected, in use, to the electro-actuator; comprising:

means for determination of an instant of end of actuation of the electro-actuator at which an injection current flowing in the actuator reaches a zero value on the basis of an electrical value correlated to the voltage present at one of said first and second output terminals.

2. The device according to claim 1, wherein said means for determination of the instant of end of injection comprise:

means for detection of the occurrence of a voltage step at the said output terminal.

3. The device according to claim 1, additionally comprising:

means for polarizing said first and second output terminals, said polarisation means comprising first and second resistor means connected respectively between said first output terminal and a supply line, and between said second output terminal and a ground line, and first and second capacitor means which are connected respectively between said first output terminal and said ground line, and between said second output terminal and said ground line.

4. The device according to claim 1, additionally comprising:

controlled switch means operable to be activated selectively in order to connect said first and second output terminals to said first and second input terminals in predetermined operative conditions; said controlled switch means comprising first controlled switch means which are connected between said first input terminal and said first output terminal, and second controlled switch means which are connected between said second input terminal and said second output terminal.

5. The device according to claim 4, wherein said first and second controlled switch means comprise MOSFET transistors.

6. A device for controlling an electro-actuator, comprising:

a first input terminal and a second input terminal operable to be connected to an electrical power source;

a first output terminal and a second output terminal operable to be connected to the electro-actuator;

a determination unit operable to determine an instant of end of injection on the basis of an electrical value correlated to the voltage present at one of said first output terminal and said second output terminals, wherein said determination unit comprises:

an occurrence detector operative to detect an occurrence of a voltage step at said first output terminal and said second output terminal; and a threshold comparator operative to compare the voltage at said first output terminal and said second output terminals with a threshold voltage and to generate a signal indicative of the instant of end of actuation of the said electro-actuator when the voltage at said first output terminal and said second output terminals has a predetermined relationship with said threshold voltage.

7. The device according to claim 6, wherein said predetermined relationship is defined by the condition that the electrical value of the voltage at said output terminal passes through a value of said threshold voltage.

8. The device according to claim 6, wherein said threshold comparator means comprise:

amplifier means which have a first and a second input connected respectively to said output terminal and to a line set to a reference potential; and voltage generator means which are connected in series to one of said inputs of said amplifier means and supply said threshold voltage.

9. A method for detection of the instant of end of actuation of an electro-actuator controlled by means of a control device, comprising a first and a second input terminal operable to be connected in use to an electrical energy source and a first and a second output terminal operable to be connected in use to said electro-actuator; the method comprising the step of:

determining said instant of end of actuation of the electro-actuator at which an injection current flowing in the actuator reaches a zero value on the basis of an electrical value which is correlated to the voltage present at one of said first and second output terminals.

10. The method according to claim 9, wherein said stage of determining said instant of end of actuation comprises the step of:

detecting the occurrence of a voltage step at said output terminal.

11. The method according to claim 10, wherein said step of detecting the occurrence of a voltage step comprises the steps of:

comparing the voltage present at the said output terminal of said control device, with a threshold voltage; and generating a signal which is indicative of the instant of end of injection, when the voltage at said output terminal of the said control circuit has a predetermined relationship with said threshold voltage.

12. The method according to claim 11, wherein said predetermined relationship is defined by the condition that a value of the voltage at said output terminal passes through a value of said threshold voltage.

* * * * *

UNITED STATES PATENT AND TRADEMARK OFFICE

CERTIFICATE OF CORRECTION

PATENT NO. : 7,191,765 B2
APPLICATION NO. : 10/993373
DATED : March 20, 2007
INVENTOR(S) : Paolo Santero It is certified that error appears in the above-identified patent and that said Letters Patent is hereby corrected as shown below:

(73) Assignee: should read C.R.F. Societa Consortile per Azioni (IT)

Signed and Sealed this

Fourteenth Day of August, 2007

JON W. DUDAS
*Director of the United States Patent and Trademark Office*